United States Patent [19]

Dikoff

[11] 3,992,789

[45] Nov. 23, 1976

[54] FORWARD RELEASING SNOW SKI BOOT

[76] Inventor: Joseph K. Dikoff, No. 4 Privateer, Apt. 3, Marina Del Rey, Calif. 90291

[22] Filed: Nov. 4, 1975

[21] Appl. No.: 628,832

[52] U.S. Cl. ..... 36/117

[51] Int. Cl.[2] ..... A43B 5/04

[58] Field of Search ..... 36/2.5 R, 2.5 AL, 61, 36/62, 117

[56] References Cited

UNITED STATES PATENTS

| | | | |
|---|---|---|---|
| 3,826,022 | 7/1974 | Gvzech | 36/2.5 AL |
| 3,834,723 | 9/1974 | Erlebach | 36/2.5 AL |
| 3,930,660 | 1/1976 | Frechin | 36/2.5 AL |

*Primary Examiner*—Patrick D. Lawson

*Attorney, Agent, or Firm*—Fulwider, Patton, Rieber, Lee & Utecht

[57] ABSTRACT

There is disclosed a forward releasing snow ski boot including a boot sole having mounted on the underside of the forward extremity thereof a toe release in the form of a pivot arm having its rear extremity pivoted against the boot sole for downward pivoting of the forward extremity thereof, such forward extremity being in the form of a toe tip for receipt in the toe piece of a conventional ski boot binding. The forward extremity of the pivot arm is normally latched in its upper position by means of a latch which, upon application of a predetermined downwardly and rearwardly acting force, will release for pivoting of the tip downwardly and rearwardly about the back extremity of the pivot arm to release such boot for forward travel with respect to the toe piece itself.

10 Claims, 5 Drawing Figures

FIG. 1
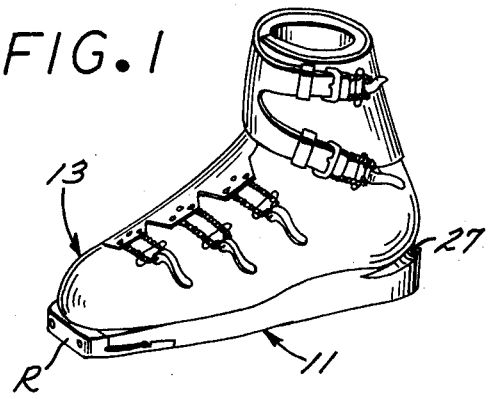
FIG. 2
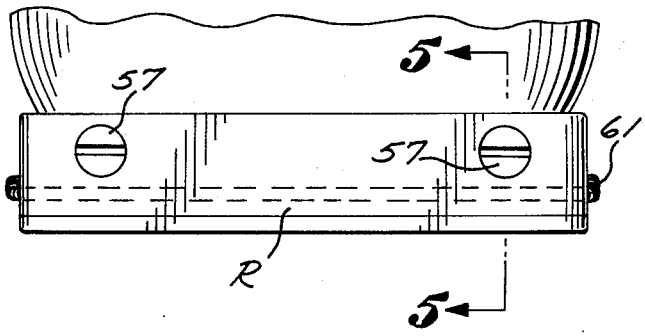
FIG. 3
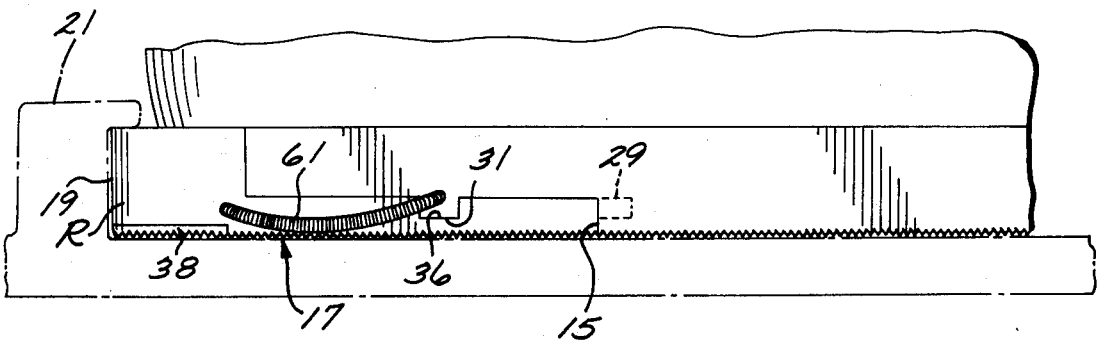
FIG. 4
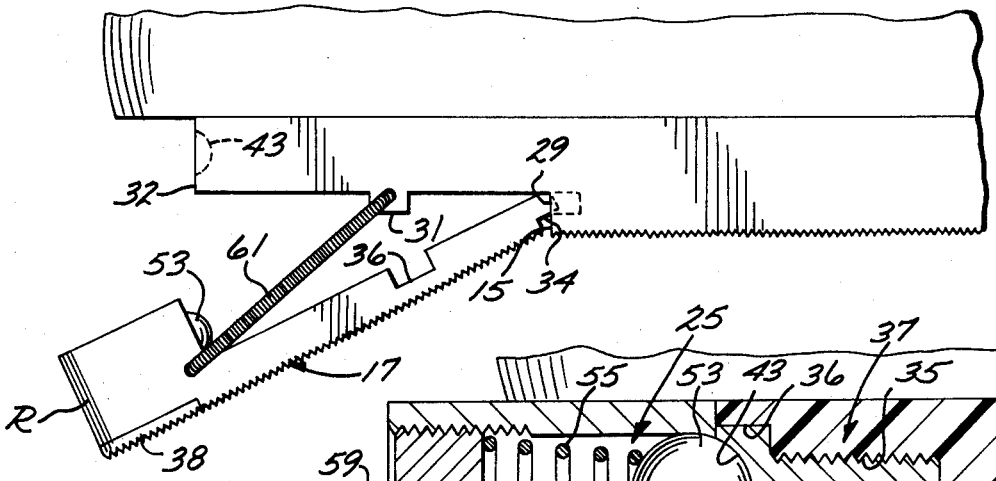
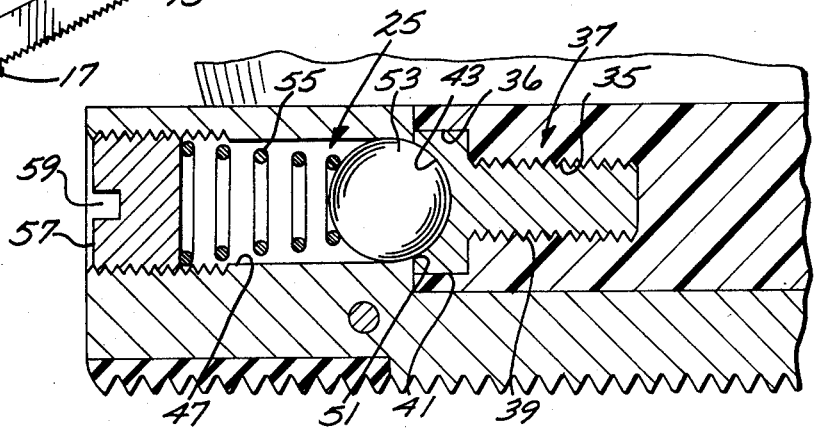
FIG. 5

FORWARD RELEASING SNOW SKI BOOT

BACKGROUND OF THE INVENTION

1. Field of the Invention:

The present invention relates generally to ski boot bindings and more particularly to a binding which will provide for forward release of a boot held captive in a binding incorporating a toe piece.

2. Description of the Prior Art:

With the present day popularity of skiing, there have been many efforts to provide for safer ski bindings which will insure the safety of the skier in the event of an uncontrolled fall or encounter with an obstacle such as a tree or other skier. These efforts have led to two divergent approaches, one being the provision of a fitting on the bottom of a boot which clamps to a ski binding mechanism in effort to cause the binding mechanism to release when predetermined torques are applied thereto or even upon the application of certain longitudinal forces such as the encounter by the tips of skis with an obstacle causing the skis themselves to stop and placing the skier in the precarious position of his body continuing forward travel while his skis are stopped. The other approach has been continued efforts in the design of bindings incorporating toe pieces which receive the toe of the sole of the ski boot and lock such toe in position for release upon the application predetermined torquest to the boots itself, thus causing the toe piece to pivot to one side or another about its vertical pivot axis. These bindings are commonly referred to as cable bindings, step-in bindings and the like. It is this type of binding to which the present invention is directed. Heretofore, such bindings have suffered the shortcoming that the toe pieces release only upon application of predetermined torques to the boot, thus resulting in the unsafe situation where the binding fails to incorporate any capability of forward release upon the ski encountering an obstacle, thus applying only forward forces to the boot itself. It is in these situations that innumerable skiers suffer serious injuries each ski season.

SUMMARY OF THE INVENTION

The forward releasing snow ski boot of the present invention is characterized by a toe release mounted on the forward underside of a ski boot and incorporating an elongated pivot arm which projects forwardly from a rear pivot point and forms at its forward extremity a toe tip for engagement with a conventional toe piece incorporated in a ski binding. The toe release is provided with a latch which will release upon application to the pivot arm of a predetermined rearwardly and downwardly acting force to thus release the pivot arm for downwardly and rearwardly pivoting of the tip to thus release the boot from the ski binding toe piece for free forward travel relative to such toe piece.

The objects and advantages of the present invention will become apparent from a consideration of the following detailed description when taken in conjunction with the accompanying drawing.

DESCRIPTION OF THE DRAWING

FIG. 1 is a perspective view of a forward releasing snow ski boot incorporating the present invention;

FIG. 2 is a partial front view, in enlarged scale, of the ski boot shown in FIG. 1;

FIG. 3 is a partial side elevational view of the ski boot shown in FIG. 1;

FIG. 4 is a partial side elevational view similar to FIG. 3 but showing the toe release in its released position; and FIG. 5 is a longitudinal sectional view, in enlarged scale, taken along the line 5—5 of FIG. 2.

DESCRIPTION OF THE PREFERRED EMBODIMENT

The forward releasing snow ski boot of the present invention includes, generally, a ski boot sole 11 having mounted threon an upper boot 13. The forward underside of the sole 11 is formed with an undercut portion defining a forwardly facing transverse support shoulder 15 having abutted thereagainst, as viewed in FIG. 3, a longitudinally projecting toe release pivot arm 17 which is formed at its forward extremity with an enlarged toe tip 19 which may be engaged with a conventional ski binding toe piece 21.

Referring to FIGS. 4 and 5, a pressure actuated release latch, generally designated 25, normally latches the pivot arm 17 in its upper position shown in FIG. 3 but is responsive to application to the forward extremity thereof of a downwardly and rearwardly acting force of a predetermined magnitude to release such forward extremity of the pivot arm for downwardly and rearwardly pivoting, as shown in FIG. 4, thus releasing the boot 13 from the toe piece 21 to protect the skier from injury.

While the toe release of the present invention may take many different forms, such as spring released sliders and the like, the preferred embodiment includes the upper boot 13 of a conventional buckle style and the sole 11 thereof is formed at its rear extremity with a transversely extending, rearwardly opening circular groove 27 for receipt of a conventional ski binding cable or heel piece which releases upon application of a predetermined force to enable the boot to pivot forwardly about the toe thereof.

As noted above, the underside of the forward extremity of the sole 11 is undercut to define the support shoulder 15 and the cavity formed by such undercut is formed with a transverse blind notch 29 with the undercut then projecting forwardly therefrom to form the downwardly facing top wall of such undercut. Such top wall is formed medially with a downwardly projecting transverse latch rib 31 and then extends forwardly to turn upwardly and form a front face 32 having formed on the lateral sides thereof a pair of rearwardly projecting, internally threaded bores 35 (FIG. 5) which are enlarged-in-diameter at their forward extremities to form counter bores 36 for receiving latch inserts, generally designated 37.

Such latch inserts 37 are formed with elongated externally threaded shanks 39 received in the bores 35 and are formed at their forward extremities with enlarged-in-diemater heads 41, such heads being formed in their forward faces with semicylindrical latch sockets 43. The pivot arm 17 is in the form of a horizontal plate having its upper surface formed to complement the shape of the undercut in the underside of the sole 11 and includes a rearwardly projecting mounting flange 34 normally received in the slot 29 and projects forwardly therefrom to form a medial transverse, upwardly opening groove for receipt over the transverse rib 31 and then projects forwardly therefrom to be increased in vertical dimension to form the upstanding toe tip 19. The underside of the pivot arm 17 is serrated and mounted on such underside at the forward tip thereof is a rubber tip plate 38 to provide for good frictional engagement with the ski itself.

Still referring to FIG. 5, the upstanding tip 19 of the pivot arm 17 is of the same vertical thickness as conventional ski boot soles and is formed with a pair of longitudinally extending, laterally disposed through bores 47 aligned with the latch sockets 43 and internally threaded at their forward extremities, the rear extremities of such bores being reduced in diameter to form limiting rings 51. Received within the bores 47 from the front extremities thereof are latching balls 53 having a diameter slightly greater than that of the retaining rings 51, to thus limit rearward travel of such balls in the bores 47 but providing for rearward projection of a portion thereof for engaging the respective sockets 43. The latch balls 53 are biased rearwardly in the bores 47 by means of conical-shaped compression springs 55 which are urged rearwardly against such balls by means of respective adjustment screws 57 which are externally threaded for receipt in the internally threaded forward extremity of the bores 57 and are formed in their front faces with slots 59 for receiving the blade of a screwdriver.

Connected between the one end of the latch rib 31 and the ski tip 19 is a 500-pound flex cable 61 which tethers the pivot arm 17 to the boot upon release thereof.

In operation, the forward releasing snow ski boot of the present invention may be utilized with ski bindings incorporating conventional toe pieces 21 adjusted to the desired height to accommodate the thickness of such tip. The skier will wear the boot of present invention in normal fashion and during normal skiing activity, the release pivot arm 17 will remain in the position shown in FIG. 4 and the skier may apply various edging and torque motions to his skis without effecting release threof. Further, if the skier loses control or encounters an obstacle resulting in a fall or other unnatural maneuver resulting in twisting of the ski relative to his leg, release of such arm 17 will not interfere with pivoting of the toe piece 21 about its normal pivot point for release of the toe of the boot to the right or left, thus permitting release in a conventional manner.

However, if an obstacle is met head-on or a similar situation is encountered resulting in the ski being stopped along its longitudinal axis resulting in the skier continuing his forward motion over the top of the ski, thus applying downwardly and rearwardly forces to the pivot arm 17, the boot 13 will be released as described hereinafter. As the force of the skier shifting forward relative to the toe piece 21 increases, the toe piece 21 will apply increasingly greater forces rearwardly and downwardly on the toe tip 19, thus causing the tip itself to be urged downwardly about its rear mounting flange 34, resulting in the balls 53 being retracted out of their latch sockets 43 (FIG. 5) against the bias of the latch springs 55 until the set force is reached, causing such balls to release. When such set force is reached, the balls 53 will clear their respective latch sockets 43, thus totally freeing the tip 19 for downward pivoting travel resulting in the pivot arm 17 pivoting downwardly and rearwardly about the rear mounting flanges 34, thus fully releasing the boot for forward travel with respect to the toe piece 21. Thus, the skier is freed to continue his forward motion, thereby preventing leg injury and possible spiral fracture.

Upon recovery from his tumble, the skier may simply insert the tethered pivot arm 17 back in position with the flange 34 being received in the notch 29 (FIG. 4). The tip 19 may then be pivoted upwardly against the bias of the flex cables 61 to the forward extremity of the arm 17 upwardly into position, thus causing the latching balls 53 to be slightly retracted into the tip 19 to enable such balls to be registered with the latch sockets 43, thus enabling the latch springs 55 to bias such balls rearwardly into the socket to maintain the arm 17 in its latched condition so the skier may again don his skis and continue skiing.

It will be appreciated that the adjustment screw 57 may be adjusted to the tension desired for the particular skill and strength of the skier and, in fact, could even be tightened so tightly that it would be tantamount to having no release on the boot independent of the ski bindings.

From the foregoing, it will be apparent that the forward releasing snow ski boot of the present invention can conveniently be used with numerous different conventional ski bindings incorporating toe pieces and significantly adds to the safety of skiing in providing a measure of safety heretofore unattainable.

Various modifications and changes may be made with regard to the foregoing detailed description without departing from the spirit of the invention.

I claim:

1. A forward releasing snow ski boot for use with a ski boot binding having a binding toe piece and comprising:

an upper boot;

a sole undermounted on said upper boot and including a forwardly facing arm supporting surface spaced in back of the toe of said sole;

a toe release mounted under said sole and including an enlongated pivot arm engaged on its rear extremity against said support surface and projecting forwardly therefrom to form on its forward extremity a toe tip for engagement with said binding toe piece, said arm being pivotable downwardly and rearwardly about said support surface; and latch means latching the forward extremity of said pivot arm to said sole and responsive to a predetermined rearwardly and downwardly acting force acting on said toe tip to release said pivot arm for pivoting downwardly and rearwardly whereby said boot may be fitted in said releaseable binding and upon the underlying ski encountering an obstacle applying said predetermined downwardly and rearwardly acting force to said pivot arm said latch means will release freeing said tip to pivot downwardly and rearwardly, thus releasing said boot to travel freely forwardly with respect to said toe piece.

2. A forwrd releasing snow ski boot as set forth in claim 1 wherein:

said latch means including a forwardly facing socket mounted on said sole and a longitudinally extending bore formed in said tip, latch balls carried in said bore and normally projecting from said bore and into said socket and bias means in said bore and normally biasing said balls into said socket.

3. A forward releasing snow ski boot as set forth in claim 1 wherein:

said sole is formed with a slot projecting rearwardly from said support surface;

said pivot arm includes a tab normally projecting rearwardly into said slot; and said mounting means includes fastening means connected between said pivot arm and said sole.

4. A forward releasing snow ski boot as set forth in claim 1 wherein:

said sole is formed at its forward extremity with a downwardly opening cut back defining at its rear extremity said support surface and projecting forwardly therefrom to be formed medially with a transversely projecting rib; and said pivot arm is formed with an upwardly opening transverse groove received over said rib.

5. A rearward releasing snow ski boot as set forth in claim 1 that includes:

adjustment means for adjusting the magnitude of force required to release said latch means.

6. A forward releasing snow ski boot as set forth in claim 1 wherein:

said toe tip projects forwardly beyond the toe of said upper boot.

7. A forward releasing snow ski boot as set forth in claim 1 that includes:

a flex cable connected on its forward extremity to said pivot arm and on its rear extremity to said sole.

8. A forward releasing snow ski boot as set forth in claim 1 wherein:

said latch means includes a metal inset mounted in said sole and including a forwardly facing surface spaced rearwardly of the toe of said upper boot and formed with a forwardly facing spherically-shaped socket; and said toe tip projects upwardly in confronting relationship with said socket and including a longitudinal passage aligned with said socket and formed at its rear extremity with a reduced-in-diameter retaining ring, latch balls received in said passage and of sufficient diameter to be held capative by said retaining ring and a biasing spring in said passage and biasing said ball rearwardly in said passage to normally engage said socket.

9. A forwardly releasing snow ski boot as set forth in claim 8 that includes:

adjustment means in said passage and adjustable to adjust the bias of said biasing spring.

10. A forwardly releasing snow ski boot as set forth in claim 8 that includes:

connecting means connected on its front extremity to said pivot arm and on its rear extremity to said sole.

* * * * *